US006302659B1

(12) United States Patent
Parker et al.

(10) Patent No.: US 6,302,659 B1
(45) Date of Patent: Oct. 16, 2001

(54) MULTI-CHAMBER POSITIVE DISPLACEMENT PUMP

(76) Inventors: Stephen Michael Parker, 6 Philanthropic Road, Redhill, Surrey RH1 4DN; Michael Peter Cooke, 52 Burnt Oak Terrace, Gillingham, Kent ME7 1DR; Peter Alban George Collingborn, 82 Burnham Walk, Rainham, Gillingham, Kent ME8 8RX; Ian Roy Thornthwaite, 1 Old Barn Close, Hempstead, Gillingham, Kent ME7 3PJ, all of (GB)

( * ) Notice: Subject to any disclaimer, the term of this patent is extended or adjusted under 35 U.S.C. 154(b) by 0 days.

(21) Appl. No.: 09/501,021

(22) Filed: Feb. 9, 2000

(30) Foreign Application Priority Data

Feb. 11, 1999 (GB) ..... 9903115

(51) Int. Cl.[7] ..... F04B 1/04; F04B 19/00; F01B 1/00

(52) U.S. Cl. ..... 417/273; 417/470; 92/72

(58) Field of Search ..... 417/273, 269, 417/522, 470; 92/72, 146; 418/86

(56) References Cited

U.S. PATENT DOCUMENTS

| | | | | |
|---|---|---|---|---|
| 459,736 | * | 9/1891 | Benham | 91/20 |
| 2,309,551 | * | 1/1943 | Trapp et al. | 103/174 |
| 2,441,797 | * | 5/1948 | Carnahan | 103/174 |
| 2,697,403 | * | 12/1954 | Benedek | 103/174 |
| 3,092,037 | * | 6/1963 | Rhodes | 103/174 |
| 3,291,001 | * | 12/1966 | Mayet et al. | 91/180 |
| 4,560,327 | * | 12/1985 | Bez et al. | 417/493 |
| 5,358,383 | * | 10/1994 | Eisenbacher et al. | 417/569 |
| 5,823,091 | * | 10/1998 | Collingborn | 92/59 |

FOREIGN PATENT DOCUMENTS

| | | |
|---|---|---|
| 2521648A | 11/1976 | (DE) . |
| 1464906 | 11/1966 | (FR) . |
| 627329 A | 8/1949 | (GB) . |
| 677538 A | 8/1952 | (GB) . |
| WO 9848169 | 10/1998 | (WO) . |

* cited by examiner

*Primary Examiner*—Charles G. Freay
*Assistant Examiner*—Timothy P. Solak
(74) *Attorney, Agent, or Firm*—David P. Gordon; David S. Jacobson; Thomas A Gallagher

(57) ABSTRACT

A multi-chamber positive displacement pump comprises a unitary housing in which is formed a plurality of cylinders. A pumping plunger is slidably mounted in each cylinder to define a pumping chamber. Means are provided for reciprocating the pumping plungers in order cyclically to vary the volume of the pumping chambers to effect delivery of a pumped fluid from the pumping chambers. A delivery passage is connected to each of the pumping chambers to receive pumped fluid therefrom, the delivery passage comprising at least one gallery formed in the unitary housing and open to an end face of the housing and passageways which extend through the unitary housing from the galleries to the pumping chambers. The galleries are closed by an end plate which is secured to the unitary housing. Feed passages and working fluid passages may likewise be defined by combination of galleries in the end face and passageways in the unitary housing. Preferably, all the galleries are in the same end face and are closed by a common end plate which acts as a mounting plate for the pump.

28 Claims, 6 Drawing Sheets

MULTI-CHAMBER POSITIVE DISPLACEMENT PUMP

BACKGROUND OF THE INVENTION

1. Field of the Invention

This invention relates to a multi-chamber positive displacement pump, and in the preferred embodiment of the invention provides a positive displacement pump suitable for delivering high pressure fuel to the fuel injection system of an internal combustion engine. It is to be understood, however, that the invention is not limited to this application and may be utilised in a wide range of multi-chamber positive displacement pumps.

2. State of the Art

Common rail fuel injection systems for internal combustion engines require the provision of a high pressure pump for supplying fuel at high pressure to the common rail or to an accumulator associated therewith. Such pumps must typically operate at pressures up to 1600 bar, and may in the future need to operate at pressures in excess of 2000 bar, and must accordingly be of the positive displacement type. In order to utilise common rail fuel injection technology in mass produced automobile engines the required fuel pump must be effective at delivering the required fuel volume and pressure, but must in addition be highly reliable, compact, and economical to manufacture. The requirements for compact and economical design are particularly difficult to meet in a pump which is required to deliver fuel reliably over many years at the pressures required by common rail fuel injection systems.

Whilst it is generally recognised that reducing the number of individual components in a particular assembly leads to an increase in reliability and a reduction in manufacturing costs, this general desideratum is often at variance with requirements for a compact design and is particularly difficult to achieve in a relatively complex mechanism such as a multi-chamber positive displacement pump.

SUMMARY OF THE INVENTION

It is the object of the present invention to provide a multi-chamber positive displacement pump in which the number of individual components is reduced as compared with prior art pumps without significant sacrifice in terms of reliability or compactness of design.

According to one aspect of the present invention there is provided a multi-chamber positive displacement pump comprising: a unitary housing in which is formed a plurality of cylinders; a pumping plunger slidably mounted in each cylinder to define a pumping chamber; means for reciprocating the pumping plungers in order cyclically to vary the volume of the pumping chambers to effect delivery of a pumped fluid from the pumping chambers; and a delivery passage connected to each of the pumping chambers to receive pumped fluid therefrom, the delivery passage comprising at least one gallery formed in the unitary housing and open to an end face of the housing and passageways which extend through the unitary housing from the gallery to the pumping chambers, the gallery being closed by an end plate which is secured to the unitary housing.

The use of a unitary housing which defines both the pumping chambers and the delivery passageway in association with an end plate which closes the galleries which form part of the delivery passages reduces to a minimum the number of components necessary for the body of the pump and minimises the number of high pressure seals required within the pump. The reduction in the number of components required and the resultant reduction in the number of seals which must be effected significantly reduces the production costs of the pump and improves the reliability thereof. In the preferred embodiment of the invention these improvements are achieved without any sacrifice in the overall size of the pump, as compared with comparable pumps having a larger number of individual components.

In the preferred embodiment of the invention the passageways in the unitary housing which form part of the delivery passage are formed by drillings which are machined from the galleries. The galleries can be formed in an end face of the housing by any convenient means, for example when the housing is forged or cast or as a subsequent machining operation, and can be formed to facilitate drilling of the passageways as required. In the preferred embodiment of the invention, in which the pump has three pumping chambers, it is preferred to provide three galleries each close to an associated pumping chamber. A delivery valve is located in a bore which connects each gallery to its associated pumping chamber and passageways associated with two of the galleries connect those galleries to the third gallery. Preferably, an outlet passage extends though the unitary housing from the third gallery to the exterior of the pump.

Preferably, the feed passages which are required to feed fluid which is to be pumped to the pumping chambers are also formed by way of galleries in an end face of the unitary housing and passageways formed in the unitary housing. The end face in which the feed galleries are formed can conveniently be the same end face as that in which the delivery galleries are formed whereby the end plate can be used to close both the delivery galleries and the feed galleries. In the case of a pump in which hydraulic pressure is used to effect movement of the pumping plungers in the feed direction, the working fluid passages which are used to supply working fluid to the pumping plunger return pistons are also formed by way of galleries in an end face of the unitary housing and passageways formed within the unitary housing. Again, the end face in which the working fluid galleries are formed is preferably the same end face as that in which the delivery galleries are formed, and the end plate is used to close the working fluid galleries.

In a particularly preferred embodiment of the invention delivery galleries, feed galleries and working fluid galleries are all formed in the same end face of the unitary housing and a common end place is used to close all the galleries.

In a particularly preferred embodiment of the invention the unitary housing defines a central chamber which houses the cam or crank mechanism used for driving the pumping plungers. In this case, an aperture is provided in the unitary housing extending from the exterior thereof to the central chamber at a point diametrically opposite each of the cylinders. The aperture may be used to gain machining access for the purposes and machining the cylinders and any bores required to house tappet gear or return pistons associated with the pumping plungers. After manufacture, the apertures are preferably closed by a plug. Under these circumstances, the feed passageways and/or the working fluid passageways can extend via the aperture. In the preferred embodiment, the working fluid passageways extend via the apertures and the closure plugs used to close the apertures after manufacture incorporate a peripheral groove to provide communication through the aperture between different parts of the working fluid passageways.

It will be appreciated that the effective closing of the delivery galleries is of critical importance. Given the very high pressures present in the delivery galleries it is difficult to provide conventional elastomeric seals which will be effective to give the required sealing. Accordingly, in the preferred embodiment of the invention the delivery galleries are sealed at the end plate by means of deformable hard material seals which, during assembly of the pump, are squeezed between the end plate and the unitary housing. By way of example, the hard material may be soft iron. In order to exert the clamping force necessary to deform the soft iron into sealing engagement with the unitary housing the screws used to secure the end plate to the unitary housing are preferably positioned adjacent each delivery gallery. Preferably, each delivery gallery has associated therewith at least two screws to produce the required clamping force.

The pressures present in the feed galleries and working fluid galleries are very substantially lower than those associated with the delivery galleries and accordingly the feed galleries and working fluid galleries can be sealed at the end plate by means of an appropriate elastomeric seal. In the preferred embodiment of the invention, a single elastomeric seal component effects sealing of all the feed galleries and all the working fluid galleries.

In the preferred embodiment of the invention a hydraulic piston arrangement is used to effect each return (fill) stroke of each pumping plunger. To this end, the tappet associated with each pumping plunger works in a cylinder machined in the unitary housing. Because of the unitary nature of the housing and the fact that both the tappet cylinder and the pumping cylinder can be machined simultaneously (or at least during the same automated machining sequence) means that there is no danger of misalignment of each pumping cylinder and its associated tappet cylinder. This means that arrangements for compensating for misalignment (such as are, for example, described in out co-pending European Patent Appliance EP-A-0972936) are not required in the case of the preferred embodiment of the present invention and a relatively simple connection between each pumping plunger and its associated tappet is all that is required. Because of this, if required, means can be provided for preventing rotation of the tappets about that their longitudinal axes. These means may, for example, be formed by a ridge in the interior space of each tappet which engages a slot formed in the unitary housing. The required ridge can, for example, be formed easily if the tappets are of sintered construction.

The invention will be better understood from the following description of a preferred embodiment thereof, given by way of example only, reference being had to the accompanying Drawings.

DETAILED DESCRIPTION OF THE PREFERRED EMBODIMENT

Figure 1:
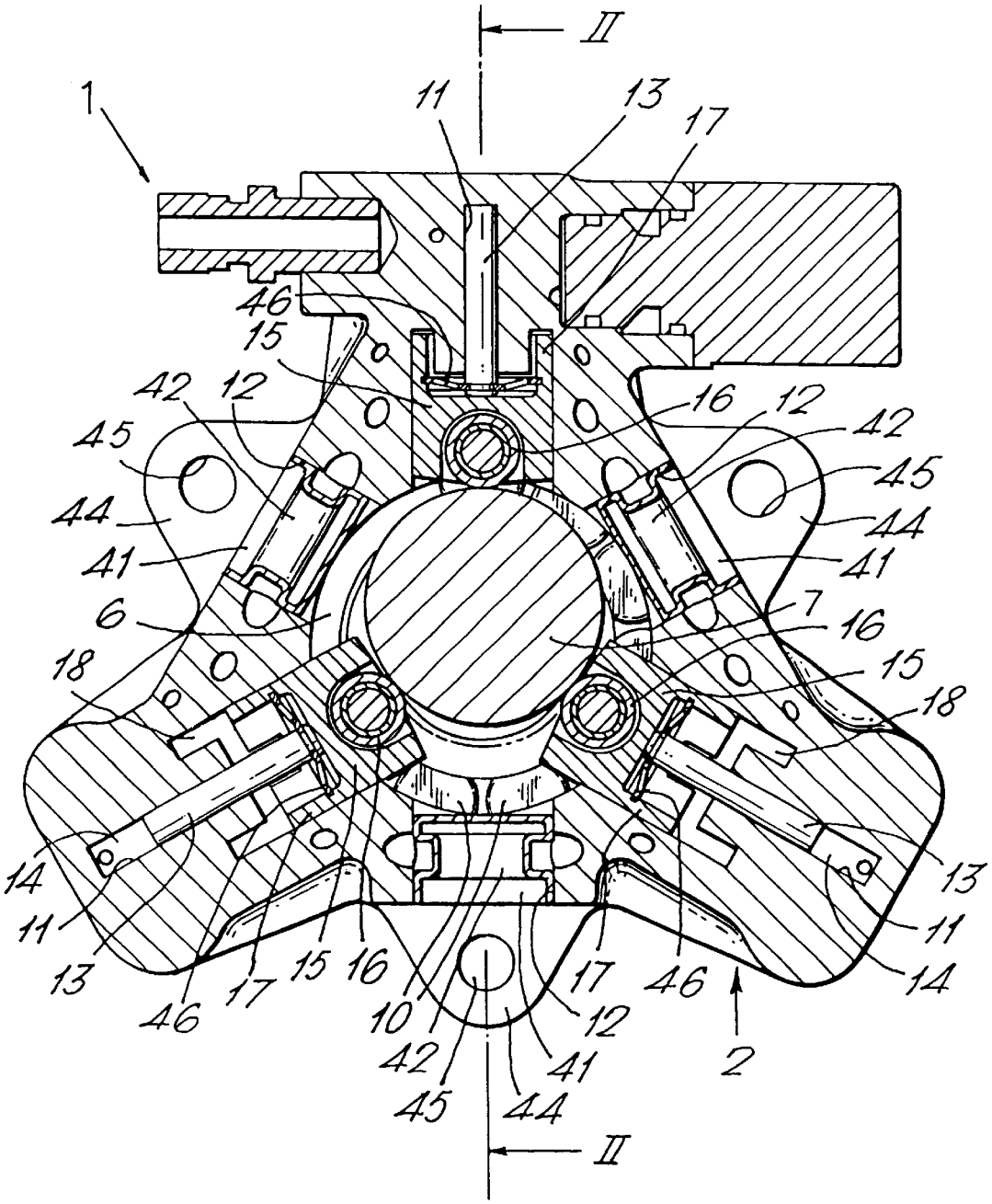
FIG. 1 is a cross-section on the line I—I of FIG. 2 showing a preferred embodiment of multi-chamber positive displacement pump according to the present invention.
Figure 2:
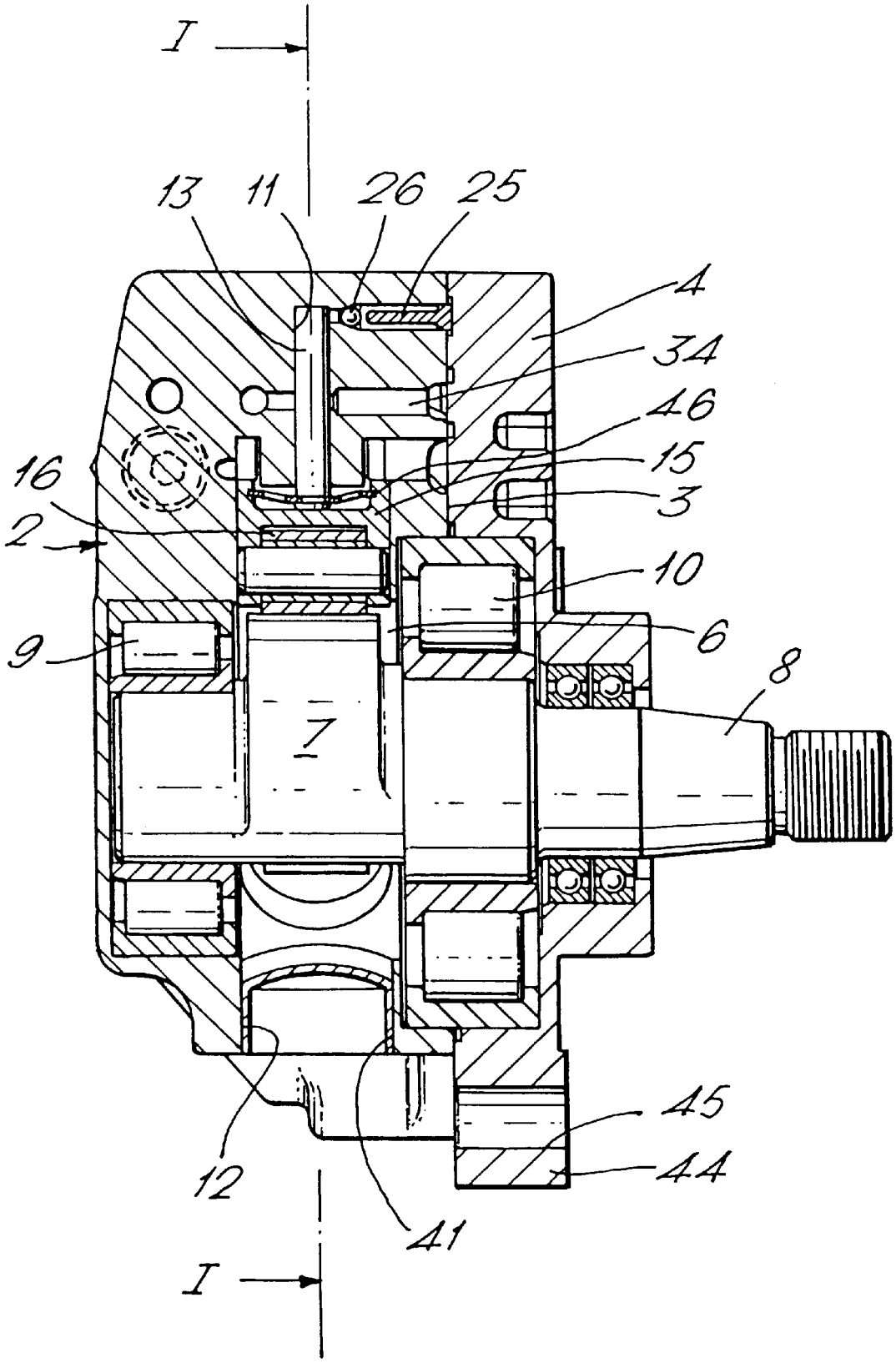
FIG. 2 is a cross-section on the line II—II of FIG. 1.

Referring to the drawings, the illustrated pump 1 comprises a unitary housing 2 of, for example, steel. The housing comprises a forging or casting which has been machined to provide various apertures, passageways and galleries. The end face 3 (FIG. 3) of the housing is flat and mates, in use, with an end plate 4 which is secured to the unitary housing by suitable bolts or screws which engage threaded holes 5 formed in the unitary housing 2.

Conveniently, the end plate 4 may be used to mount the pump on the cylinder block of its associated engine. To this end, the end plate is formed with lugs 44 having fixing holes 45. To the extent that different engines will require different fixing hole arrangements these can readily be accommodated by using different end plates.

The housing 2 defines a central chamber 6 which, in the assembled pump, houses the eccentric 7 of a crank shaft 8 which is mounted in the housing 2 and end plate 4 by means of respective bearings 9,10. Three pumping cylinders 11 are formed in the unitary housing by machining via apertures 12 which extend from the exterior of the housing to the chamber 6.

Each cylinder 11 has slidably mounted therein a pumping plunger 13 so that three pumping chambers 14 are formed. It will be noted that the pumping chambers 14 are formed entirely within the unitary housing 2 and the pumping plungers and only these two components are used to form and close the pumping chambers.

In order to effect the required movement of the pumping plungers 13 in the forward (delivery) direction, each pumping plunger 13 has secured thereto a tappet assembly 15 which includes a roller 16 rotatably mounted on a shaft secured to a tappet shell 17. In use, as the crank shaft 8 is rotated, the pumping plungers 13 are successively moved from bottom dead centre to top dead centre to deliver pumped fluid from the pumping chambers 14. In order to effect the return (fill) stroke of each pumping plunger 13, a suitable working fluid, for example pressurised fuel, or pressurised lubricating oil from an engine lubrication system, is delivered to a working chamber 18 defined between each respective tappet shell 17 and the unitary housing 2. The presence of pressurised fluid in the chambers 18 exerts a continuous radially inward force on the tappet shell 17. This force is transmitted from the tappet shells 17 to the pump plungers 17 and is sufficient to effect the required return (fill) stroke of the pumping plungers.

In order to provide for operation in the pump described above three separate sets of passages are required, namely: a delivery passage for receiving pumped fluid from each of the pumping chambers and delivering such fluid to the pump outlet; a feed passage to take fluid to be pumped from the pump inlet to each of the pumping chambers; and a working fluid passage to provide working fluid to the chambers 18 to effect the return (fill) strokes of the pumping plungers. In the case of the preferred embodiment of the invention the various passages are provided by means of passageways and galleries formed in the unitary housing 2, the galleries being closed by the end plate 4. This arrangement gives rise to a particularly desirable configuration in which the number of seals required is small and the design is compact.

Figure 3:
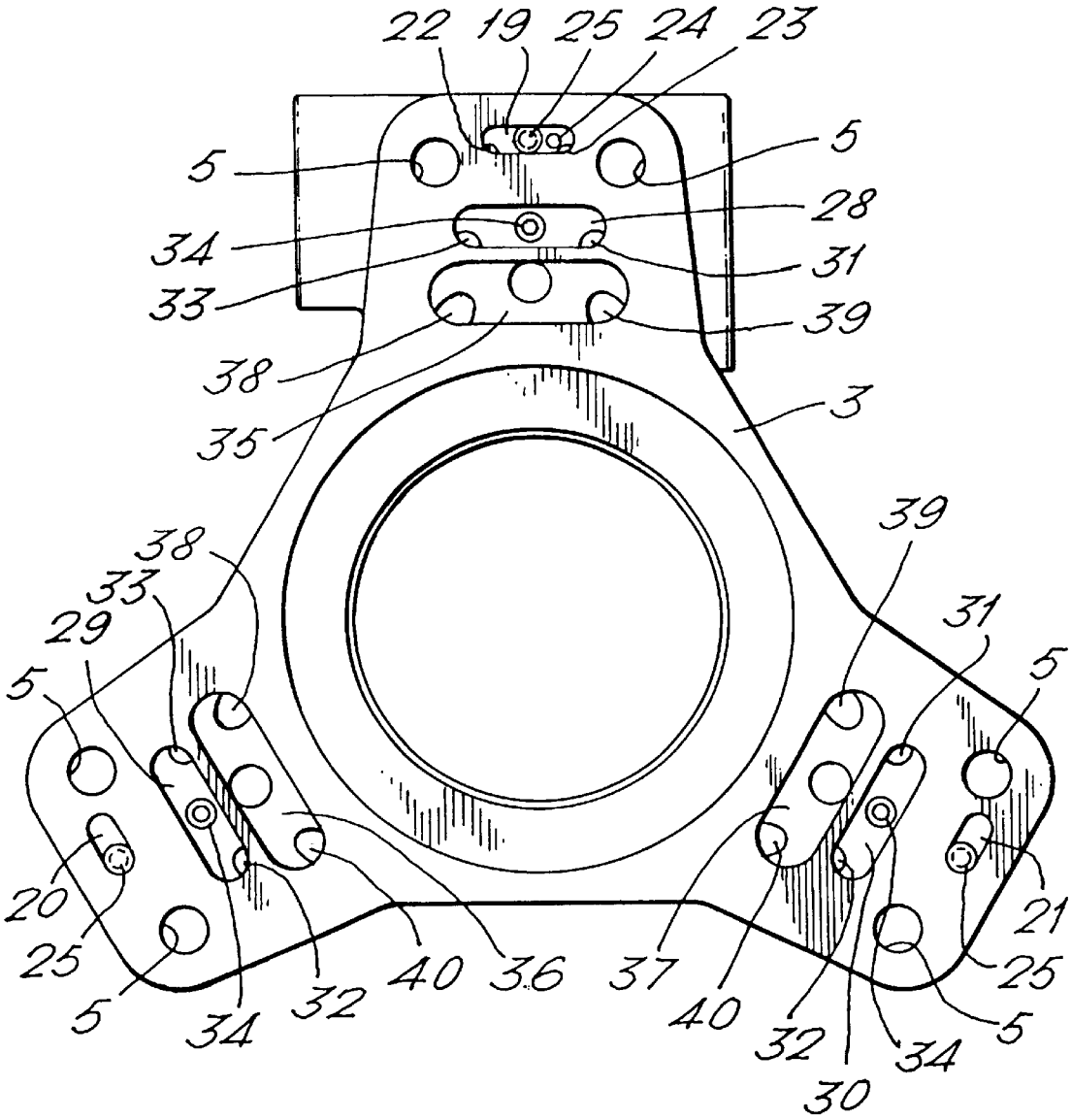
FIG. 3 is a view of the end face of the housing of the pump of FIGS. 1 and 2.
Figure 4:
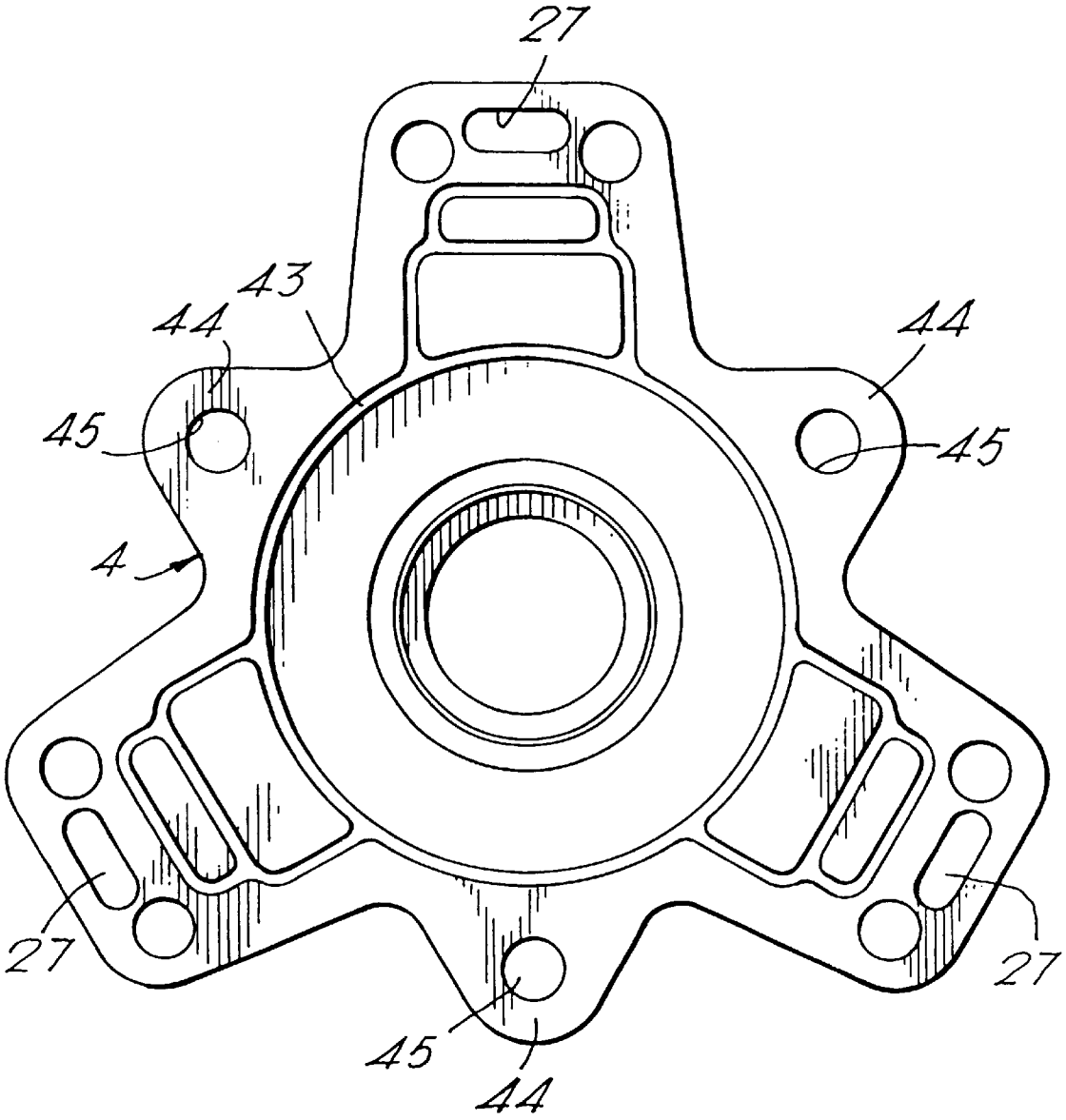
FIG. 4 is a view of the face of the end plate of the pump of FIGS. 1 and 2 which mates with the end face of the pump housing.
Figure 5:
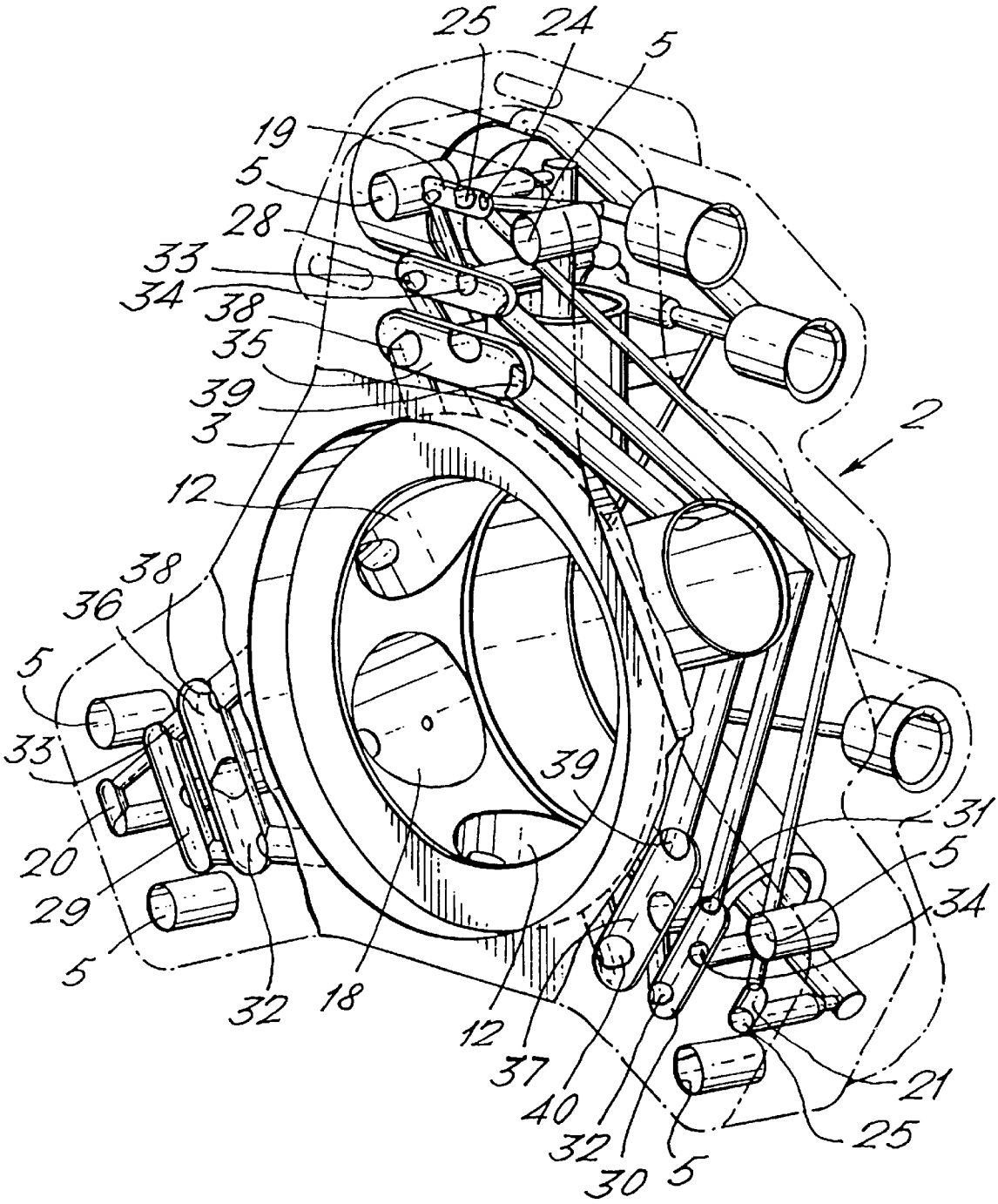
FIG. 5 is a perspective ghost view of the housing of the pump of FIGS. 1 and 2, with the various internal passageways and galleries of the housing shown.

With further reference to FIGS. 3–5, and referring firstly to the delivery passage, this is formed by delivery galleries 19, 20 and 21, a delivery passageway 22 which connects the delivery gallery 20 to the delivery gallery 19, a delivery passageway 23 which connects the delivery gallery 21 to the delivery gallery 19, and an outlet passage 24 which connects the delivery gallery 19 to an appropriate outlet fitting secured to the pump. The galleries 19, 20 and 21 are formed in the end face 3 of the unitary housing, for example by machining. The galleries can be easily formed to an optimum profile, for example the ends may be part-spherical to avoid stress concentrations and to provide optimum entry conditions for drilling the passageways 22, 23 and 24. Each of the galleries 19, 20, 21 is connected directly to its associated pumping chamber 14 by means of a drilling 25 which houses a delivery valve 26. The passageways 22, 23 and 24, and the drillings 25 are all formed exclusively in the unitary housing.

In order to close the galleries 19, 20, 21 at the end face 3, suitable seals (not shown), for example of soft iron, are provided in conforming slots 27 (FIG. 4) provided in the end plate 4. The thickness of the seals is slightly greater than the depth of the slots, and the area of each slot is slightly larger than the area of its corresponding gallery so that the seals are squeezed firmly against the zone of the housing end face 3 surrounding the galleries as the end plate is bolted to the housing. It will be noted in this context that the fixing screws used to secure the end plate 4 of the housing 2 are located immediately adjacent the galleries with each gallery being located substantially between two screws. Accordingly, a massive clamping force is available to ensure an adequate high pressure seal. The high pressure seals effected at the galleries are the only high pressure seals required in the entire delivery passage network.

In a manner similar to that described above with reference to the delivery passage, the feed passage is provided by way of feed galleries 28, 29 and 30 provided in the end face 3 of the housing 2 and feed passageways 31, 32 and 33 formed in the housing. The feed passageway 31 extends through the housing from the feed gallery 28 to the feed gallery 30; the feed passageway 32 extends through the housing from the feed gallery 30 to the feed gallery 29; and the feed passageway 33 extends through the housing from the feed gallery 29 to the feed gallery 28. It will be noted that each feed gallery 28, 29, 30 is accordingly connected to each of the adjacent feed galleries. This arrangement minimises back pressure as a result of flow resistance and inertia. Two parallel though unequal length paths are available from the metering valve to each feed gallery. Each feed gallery is connected to its associated pumping chamber 14 by a passage 34 which extends through the housing and enters its associated pumping chamber 14 at a point immediately radially outwardly of the position of the end face of the associated pumping plunger when the pumping plunger is at bottom dead centre.

Working fluid, for example pressurised fuel or lubricating oil, is fed to the working chambers 18 via working fluid galleries 35, 36, and 37 formed in the end face 3 of the housing 2 and by means of working fluid passageways 38, 39, 40. The working fluid passageway 38 connects the working fluid gallery 35 to the working fluid gallery 36; the working fluid passageway 39 connects the working fluid gallery 35 to the working fluid gallery 37; and the working fluid passageway 40 connects the working fluid gallery 36 to the working fluid gallery 37 The working fluid passageways 38, 39, 40 are formed in the unitary housing 2 and extend via the apertures 12 which extend from the exterior of the body to the central chamber 6. To this end, closure plugs 41 (FIG. 4) which close the apertures 12 are each formed with a peripheral groove 42 to give the necessary continuity to the working fluid passageways. It will be appreciated that the pressure present in the working fluid passageways is relatively small and, in any event, any small leakage of working fluid from the grooves 42 inwardly to the chamber 6 will assist in lubricating the crank shaft and tappet rollers. The plugs 41 are pressed into position and are self-sealing to the pump exterior. The working fluid passage arrangement described above provides working fluid passages of generous proportions which is desirable in preventing excessive pressure spikes due to flow accelerations and ensures that there are periods of each revolution when the pressure in the working fluid circuit is low enough to permit make up of leakage past the tappets from the inlet pressure. If necessary, a pressure accumulator is provided in the working fluid circuit and a non-return valve isolates the working fluid circuit from the source of working fluid when pressure in the working fluid passage exceeds the inlet pressure of the working fluid.

The feed galleries and working fluid galleries are sealed at the end plate 4 by means of an elastomeric seal. The arrangement of the galleries facilitates use of a single seal component to effect required sealing. The seal component may be an elastomeric seal of "O" cross-section in which case a groove 43 (FIG. 4) is formed in the end plate to house the required seal component. Alternative sealing arrangements for the feed galleries and working fluid galleries may be used. It will be noted in this context that the operating pressures within these galleries are relatively small and accordingly no great difficulty should be encountered in providing effective sealing.

Figure 6:
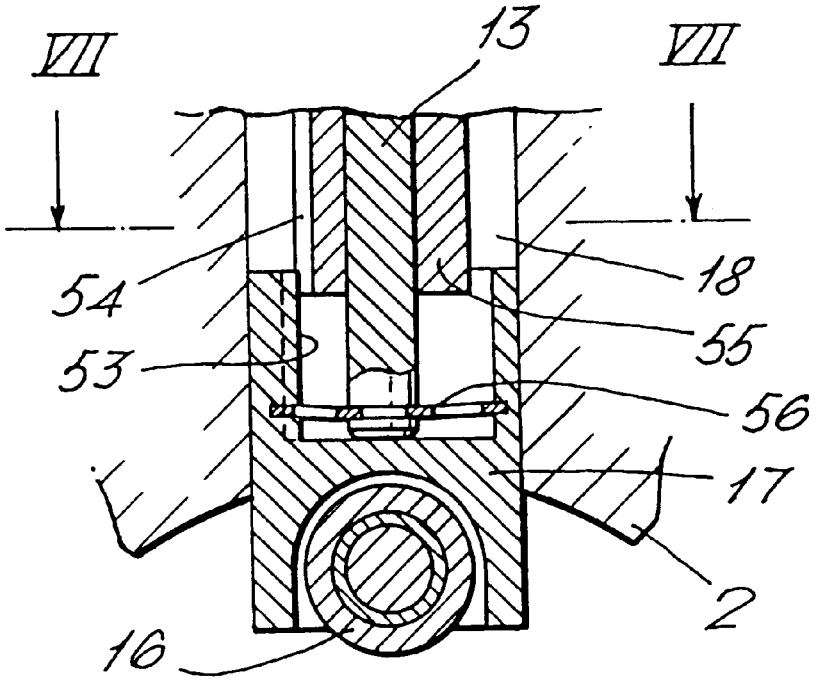
FIG. 6 illustrates in detail the tappet assembly associated with one of the pumping plungers of the pump of FIGS. 1 and 2.
Figure 7:
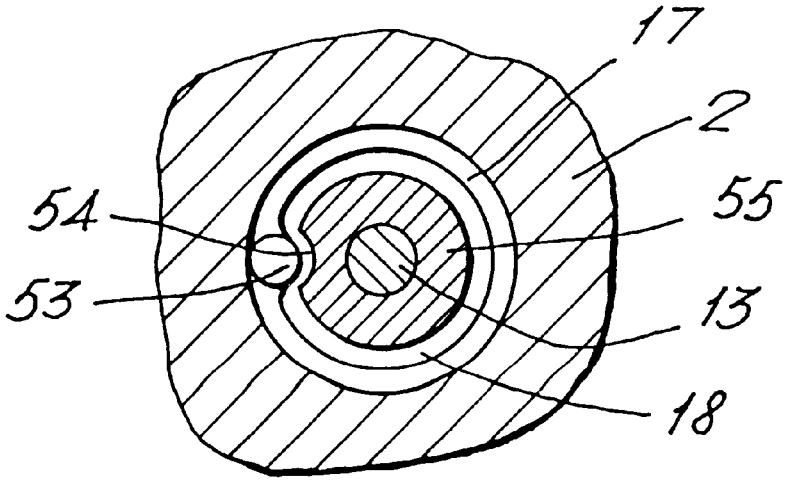
FIG. 7 is a cross-section on the line VII—VII of FIG. 6.

It will be appreciated that in the above described pump the pumping cylinders 11 can be machined simultaneously with, or at least during the same machining operation as, the cylinders forming the working chambers 18. Accordingly, there is no risk of either axial or angular misalignment of the pumping cylinders 11 with the associated cylinders in which the tappets 15 slide. For this reason, a relatively simple connection between the pumping plungers 13 and their associated tappet assemblies 15 is possible. This connection can be effective, for example, by way of a circlip. This is in contrast to the arrangement described in our U.K. patent application 9815272 where, because of possible misalignment between the cylinders in which the pumping plungers work and the cylinders in which the tappets work a relatively complicated connection between the pumping plungers and the tappets is required. As a result of the relatively simple connection arrangement required by the present invention, means may be provided, if desired, for preventing rotation of the tappets within their bores. During pumping action the tappet rollers align themselves to the cam face. However, at top and bottom of stroke the tendency of the rollers to align themselves with the cam is small and unwanted twisting of the tappets could occur. Also, because hydraulic force is used to maintain the tappet rollers in engagement with the cam there is the possibility on assembly or at start up that misalignment may occur. In a preferred embodiment of the present invention and as seen in FIGS. 6 and 7 each tappet shell 17 is formed with an inwardly extending ridge 53 which runs in a corresponding slot 54 formed in the spigot 55 which defines the cylinder 11. The slot 54 may be formed easily by drilling subsequent to, but in the same machining operation as, the pumping cylinders and tappet cylinders are formed.

Conveniently, the ridge 53 can be formed when the tappet shell is moulded prior to sintering, if a sintering process is employed to produce the tappet blank. The ridge 53 can be machined to provide a seating for the plunger retaining circlip 56 or, in the alternative, may be used to align the gap in the circlip which would facilitate rotationally fixing the pumping plunger to the tappet shell, if this was required.

The working fluid may be fuel supplied to the positive displacement pump from a low pressure transfer pump or may be pressurised lubricating oil, for example from the engine lubrication system. In either event, a backleak connection may be provided to allow a circulation of working fluid to ensure that the working fluid does not become overheated.

If desired, tappet orientation may be effected by means of screwed-in plugs rather than the ridges described above.

What is claimed is:

1. A multi-chamber positive displacement pump comprising:

a unitary housing in which is formed a plurality of cylinders;

a pumping plunger slidably mounted in each cylinder to define a pumping chamber;

means for reciprocating the pumping plungers in order cyclically to vary the volume of the pumping chambers to effect delivery of a pumped fluid from the pumping chambers;

a delivery passage connected to each of the pumping chambers to receive pumped fluid therefrom, the delivery passage comprising at least one gallery formed in the unitary housing and open to an end face of the housing and passageways which extend through the unitary housing from the gallery to the pumping chambers, the gallery being closed by an end plate which is secured to the unitary housing; and a plurality of feed passages to feed fluid to the pumping chambers, wherein the feed passages are also formed by galleries in an end face of the unitary housing and passageways formed in the unitary housing, wherein the end face in which the feed galleries are formed is the same end face as that in which the delivery galleries are formed and the end plate closes both the delivery galleries and the feed galleries.

2. A multi-chamber positive displacement pump according to claim 1 wherein the passageways in the unitary housing which form part of the delivery passage are formed by drillings which are machined from the galleries.

3. A multi-chamber positive displacement pump according to claim 2 wherein the pump includes three pumping chambers; wherein a gallery is located adjacent each pumping chamber, wherein a bore connects each gallery to a respective pumping chamber; and wherein a delivery valve is located in each bore.

4. A multi-chamber positive displacement pump according to claims 3, wherein passageways associated with two of the galleries connect those galleries to the third gallery and wherein an outlet passage extends through the unitary housing from the third gallery to the exterior of the pump.

5. A multi-chamber positive displacement pump according to claim 1 wherein the pump includes three pumping chambers; wherein a gallery is located adjacent each pumping chamber; wherein a bore connects each gallery to a respective pumping chamber; and wherein a delivery valve is located in each bore.

6. A multi-chamber positive displacement pump according to claim 3 wherein passageways associated with two of the galleries connect those galleries to the third gallery and wherein an outlet passage extends through the unitary housing from the third gallery to the exterior of the pump.

7. A multi-chamber positive displacement pump according to claim 1, wherein:

working fluid passages are provided to supply working fluid to return pistons connected to the pumping plungers, hydraulic pressure of the working fluid effecting movement of the pumping plungers in the fill direction during use, and wherein the working fluid passages are formed by way of galleries in an end face of the unitary housing and passageways formed within the unitary housing.

8. A multi-chamber positive displacement pump according to claim 7 wherein the end face in which the working fluid galleries are formed is the same end face as that in which the delivery galleries are formed and the end plate closes both the delivery galleries and the working fluid galleries.

9. A multi-chamber positive displacement pump according to claim 1 wherein the unitary housing defines a central chamber which houses a cam or crank mechanism used for driving the pumping plungers; an aperture is provided in the unitary housing extending from the exterior thereof to the central chamber at a point diametrically opposite each of the cylinders; and wherein the aperture is used to gain machining access for the purpose of machining the cylinders and any bores required to house tappet gear or return pistons associated with the pumping plungers.

10. A multi-chamber positive displacement pump according to claim 9 wherein the apertures are each closed by a plug and the feed passageways and/or the working fluid passageways extend via the apertures.

11. A multi-chamber positive displacement pump according to claim 10 wherein the working fluid passageways extend via the apertures and each closure plug incorporates a peripheral groove to provide communication through the aperture between different parts of the working fluid passageways.

12. A multi-chamber positive displacement pump according to claim 1 wherein the delivery galleries are sealed at the end plate by means of deformable hard material seals which, during assembly of the pump, are squeezed between the end plate and the unitary housing.

13. A multi-chamber positive displacement pump according to claim 12 wherein the seals are of soft iron.

14. A multi-chamber positive displacement pump according to claim 1 wherein the end plate includes fixing means permitting the pump to be secured to an internal combustion engine.

15. A multi-chamber positive displacement pump comprising:

a unitary housing in which is formed a plurality of cylinders;

a pumping plunger slidably mounted in each cylinder to define a pumping chamber;

means for reciprocating the pumping plungers in order cyclically to vary the volume of the pumping chambers to effect delivery of a pumped fluid from the pumping chambers; and a delivery passage connected to each of the pumping chambers to receive pumped fluid therefrom, the delivery passage comprising at least one gallery formed in the unitary housing and open to an end face of the housing and passageways which extend through the unitary housing from the gallery to the pumping chambers, the gallery being closed by an end plate which is secured to the unitary housing, wherein working fluid passages are provided to supply working fluid to return pistons connected to the pumping plungers, hydraulic pressure of the working fluid effecting movement of the pumping plungers in the fill direction during use, and wherein the working fluid passages are formed by way of galleries in an end face of the unitary housing and passageways formed within the unitary housing, and wherein the end face in which the working fluid galleries are formed is the same end face as that in which the delivery galleries are formed and the end plate closes both the delivery galleries and the working fluid galleries.

16. A multi-chamber positive displacement pump according to claim 15, wherein:

the passageways in the unitary housing which form part of the delivery passage are formed by drillings which are machined from the galleries.

17. A multi-chamber positive displacement pump according to claim 16, wherein:

the pump includes three pumping chambers;

a gallery is located adjacent each pumping chamber;

a bore connects each gallery to a respective pumping chamber; and a delivery valve is located in each bore.

18. A multi-chamber positive displacement pump according to claim 17, wherein:

passageways associated with two of the galleries connect those galleries to the third gallery and an outlet passage extends through the unitary housing from the third gallery to the exterior of the pump.

19. A multi-chamber positive displacement pump according to claim 15, wherein:

the pump includes three pumping chambers;

a gallery is located adjacent each pumping chamber;

a bore connects each gallery to a respective pumping chamber; and a delivery valve is located in each bore.

20. A multi-chamber positive displacement pump according to claim 19, wherein:

passageways associated with two of the galleries connect those galleries to the third gallery; and an outlet passage extends through the unitary housing from the third gallery to the exterior of the pump.

21. A multi-chamber positive displacement pump according to claim 15, further comprising:

feed passages to feed fluid to the pumping chambers, wherein the feed passages are also formed by galleries in an end face of the unitary housing and passageways formed in the unitary housing.

22. A multi-chamber positive displacement pump according to claim 21, wherein:

the end face in which the feed galleries are formed is the same end face as that in which the delivery galleries are formed and the end plate closes both the delivery galleries and the feed galleries.

23. A multi-chamber positive displacement pump according to claim 15, wherein:

the unitary housing defines a central chamber which houses a cam or crank mechanism used for driving the pumping plungers;

an aperture is provided in the unitary housing extending from the exterior thereof to the central chamber at a point diametrically opposite each of the cylinders; and the aperture is used to gain machining access for the purpose of machining the cylinders and any bores required to house tappet gear or return pistons associated with the pumping plungers.

24. A multi-chamber positive displacement pump according to claim 23, wherein:

the apertures are each closed by a plug and the feed passageways and/or the working fluid passageways extend via the apertures.

25. A multi-chamber positive displacement pump according to claim 24, wherein:

the working fluid passageways extend via the apertures and each closure plug incorporates a peripheral groove to provide communication through the aperture between different parts of the working fluid passageways.

26. A multi-chamber positive displacement pump according to claim 15, wherein:

the delivery galleries are sealed at the end plate by means of deformable hard material seals which, during assembly of the pump, are squeezed between the end plate and the unitary housing.

27. A multi-chamber positive displacement pump according to claim 26, wherein the seals are of soft iron.

28. A multi-chamber positive displacement pump according to claim 15, wherein:

the end plate includes fixing means permitting the pump to be secured to an internal combustion engine.

* * * * *